US005427513A

United States Patent [19]

Yamada et al.

[11] Patent Number: 5,427,513

[45] Date of Patent: Jun. 27, 1995

[54] SCROLL TYPE COMPRESSOR HAVING A DISPLACED DISCHARGE PORT

[75] Inventors: Kiyohiro Yamada; Izuru Shimizu; Shinya Yamamoto; Tetsuhiko Fukanuma, all of Kariya, Japan

[73] Assignee: Kabushiki Kaisha Toyoda Jidoshokki Seisakusho, Kariya, Japan

[21] Appl. No.: 161,875

[22] Filed: Dec. 2, 1993

[30] Foreign Application Priority Data

Dec. 3, 1992 [JP] Japan ..... 4-324502

[51] Int. Cl.[6] ..... F04C 18/04; F04C 27/00

[52] U.S. Cl. ..... 418/55.2; 418/55.4; 418/142

[58] Field of Search ..... 418/55.1, 55.2, 55.4, 418/142

[56] References Cited

U.S. PATENT DOCUMENTS 4,498,852 2/1985 Hiraga ..... 418/55.4
5,217,358 6/1993 Mori et al. ..... 418/55.2

FOREIGN PATENT DOCUMENTS 62-276289 12/1987 Japan ..... 418/55.2
1187390 7/1989 Japan ..... 418/55.2
2308990 12/1990 Japan .
392591 4/1991 Japan .

*Primary Examiner*—John J. Vrablik
*Attorney, Agent, or Firm*—Brooks Haidt Haffner & Delahunty

[57] ABSTRACT

An improved scroll type compressor having a discharge port that is offset from the maximum compression pocket a predetermined distance and radial direction so as to minimize the cantilevered exposure over the discharge port of the terminal tip of a fluid seal that is disposed within a groove in the end surface of the orbiting spiral element facing the fixed end plate.

7 Claims, 6 Drawing Sheets

SCROLL TYPE COMPRESSOR HAVING A DISPLACED DISCHARGE PORT

BACKGROUND OF THE INVENTION

1. Field of the Invention

The present invention relates generally to a scroll type compressor having a seal at the tip of the spiral element. More specifically, the present invention relates to a sealing mechanism to improve durability of the seal.

2. Description of the Related Art

Gaseous fluid compressors have a wide variety of applications such as in an automobile air conditioning system and/or a refrigeration system. A variety of compressor architectures are available for application compatibility. Among those compressors, scroll type compressors have superior work efficiency and are suitable to be employed in a system requiring a small discharge displacement. Japanese Unexamined Patent Publication No. 3-92591 discloses a typical scroll type compressor.

As shown in FIGS. 7 and 8, a conventional scroll type compressor generally includes a fixed scroll 60 having a spiral element 50 that is formed on a end plate 55 and an orbiting scroll 61 is interfitted with the scroll 60. The fixed and orbiting scrolls 60, 61 include spiral elements 50, 51 that are formed on and continuous with the end plate, respectively. The orbiting scroll 61 is eccentrically disposed with respect to the center axis of the fixed scroll 60, and orbits around the above-described axis without self-rotation around its axis while both spiral elements 50, 51 are interfitted to form line contacts. Refrigerant gas is introduced into compression chambers P1, P2 defined by the spiral elements 50, 51 and the end plates 55, respectively. The air-tight compression chambers P1, P2 successively move toward the center portions of the spiral elements 50, 51 according to orbital rotation of the orbiting scroll 61. During the orbiting motion of the scroll 61, the volume of the compression chambers P1, P2 decrease. The compressed gas is discharged to a discharge chamber through a discharge port 54 that is formed in the central portion of the end plate 55 of the fixed scroll 60.

A groove 53 is formed in a tip end surface of the orbiting spiral element 51 that contacts with the fixed end plate 55. A seal 52 is accommodated in the groove 53 for improving air tightness within the compression chamber P1 that is defined by both spiral elements 50, 51. While the refrigerant gas is being compressed, the seal 52 is urged against the surface of the fixed end plate, in order to prevent the refrigerant gas leakage from the high pressurized compression chamber P1 to the low pressurized compression chamber P2. Further, as the compression chamber P1 approaches the discharge port, internal pressure thereof increases. Therefore, the seal 52 includes an enlarged portion **52*a* that is formed at the central end portion thereof. The enlarged portion 52*a*** improves the air tightness of the compression chamber that is approaching the discharge port.

As shown in FIG. 7, the center of the discharge port 54 of the above-described conventional scroll type compressor is located on a line H that passes through an initial point E of inner peripheral surface S of the fixed spiral element 50 and a center point $O_2$ of involute generating circle K for generating an involute curve. The line H is perpendicular to the tangent line drawn at the initial point E of the inner peripheral surface S. Therefore, the compressed refrigerant gas is efficiently discharged from the minimized compression chamber P1 in the final compression stage through clearance defined in the vicinity of the initial point E of the discharge port 54.

However, the discharge port 54 is assigned to the fixed location such that the entire discharge port is enabled to be fit within the involute generating circle K. Therefore, a tip portion of the spiral element 51 that forms the minimized compression chamber P1 in the final compression stage covers almost the entire discharge port 54. At this moment, the entire tip portion of the enlarged tip portion **52*a* confronts against the discharge port 54. The tip portion of the enlarged tip portion 52*a* tends to bend inward into the discharge port 54 as indicated by a double dotted line in FIG. 8, based upon the suctional action of compressed gas flow. If the tip portion of the seal is repeatedly bent, the tip portion thereof is stressed so that the durability thereof may be lowered. Further, if the above-described case occurs, the tip portion of the enlarged tip portion 52*a* may hit to the edge of wall portion of the discharge port 54**, and may be damaged.

SUMMARY OF THE INVENTION

Accordingly, it is a primary objective of the present invention to provide an improved scroll type compressor including a seal that is disposed in the distal surface of the spiral element of the orbiting scroll such that stress and wear of the seal are reduced. As a result, the durability of the seal is significantly extended.

To achieve the foregoing and other objects and in accordance with the purpose of the present invention, an improved scroll type compressor is provided. The compressor according to the teachings of the invention includes a fixed scroll having a fixed end plate and a fixed involute spiral element and an orbiting scroll having an orbiting end plate and an orbiting involute spiral element. The inner peripheral surface of the spiral element is defined by the locus of points of a curve generated based upon a phantom circle imaginarily located in the fixed end plate. The orbiting spiral element has an end surface with a groove dispersed therein contacting said fixed end plate, a fluid seal being dispersed within said groove. The fixed and orbiting spiral elements being radially and angularly offset and interfit with each other to provide line contacts extending between the fixed and orbiting plates defining a fluid pocket therebetween, which fluid pocket is urged to the center of the fixed and orbiting scrolls by the movement of the orbiting scroll. A discharge port is disposed in the fixed end plate remotely from the center of the phantom circle toward the tip of the fixed spiral element with a predetermined distance so as to minimize cantilever exposure of the terminal tip of the fluid seal over the discharge port. When the discharge port is completely removed from the center of the phantom circle so as not to communicate with the high pressure fluid pocket formed by, and at the center of, the fixed and orbiting spiral elements, then a communicating passage recess is disposed in the fixed end plate for communicating said final compression fluid pocket with said discharge port. Again the discharge port is located at a distance from the center of the phantom circle to minimize the cantilever exposure of the terminal tip of the fluid seal over the combined fluid discharge port and communicating passage.

Preferred embodiments of the invention include defining the predetermined portion of the center of the fixed and orbiting scrolls to be the locus of points of the phantom circle (K) that generales the involute curve of the inner peripheral surface of the fixed scroll involute spiral element having an inner terminal and starting point $E_1$. The discharge port center ($O_1$) is located at a distance greater than the radius of the involute generating phantom circle (K) and has a smaller radius than the distance between the center ($O_1$) on a line (H) extending between the center of said involute generating circle K and said starting point ($E_1$). Further, the center ($O_1$) of the discharge port is located on the opposite side of the fixed involute inner peripheral surface ($S_1$) with respect to said line (H) and the radius of the discharge port is smaller than the perpendicular distance between the center ($O_1$) and the line (H). The preferred embodiment of the invention has a similarly spiral groove formed on the fixed spiral element of the fixed scroll into which a similar fluid seal is disposed so as to provide a fluid seal between the end surface of the fixed spiral and the orbiting end plate. The grooves and fluid seals of the inner end tips of the fixed and orbiting spiral elements have a wider width than other portions to provide increased fluid sealing in the maximum compression pocket.

BRIEF DESCRIPTION OF THE DRAWINGS

The feature of the present invention that are believed to be novel are set forth with particularity in the appended claims. The invention, together with objects and advantages thereof, may best understood by reference to the following description of the preferred embodiments together with the accompanying drawings, in which:

FIGS. 1 through 6 illustrate an embodiment of a scroll type compressor according to the present invention, wherein:

FIG. 1 is a cross-sectional view of a fixed and orbiting spiral elements that are interfitted each other;

FIG. 2 is an enlarged cross-sectional view of tip portions of both spiral elements of FIG. 1;

FIG. 3 is a cross-sectional view taken along the line 3—3 shown in FIG. 2;

FIG. 4 is a perspective view of the tip portion of the spiral element shown in FIG. 2;

FIG. 5 is a cross-sectional view showing an entire scroll type compressor;

DETAILED DESCRIPTION OF THE PREFERRED EMBODIMENT

A preferred embodiment according to the present invention will now be described in greater detail, with reference to FIGS. 1 through 5.

Figure 5:
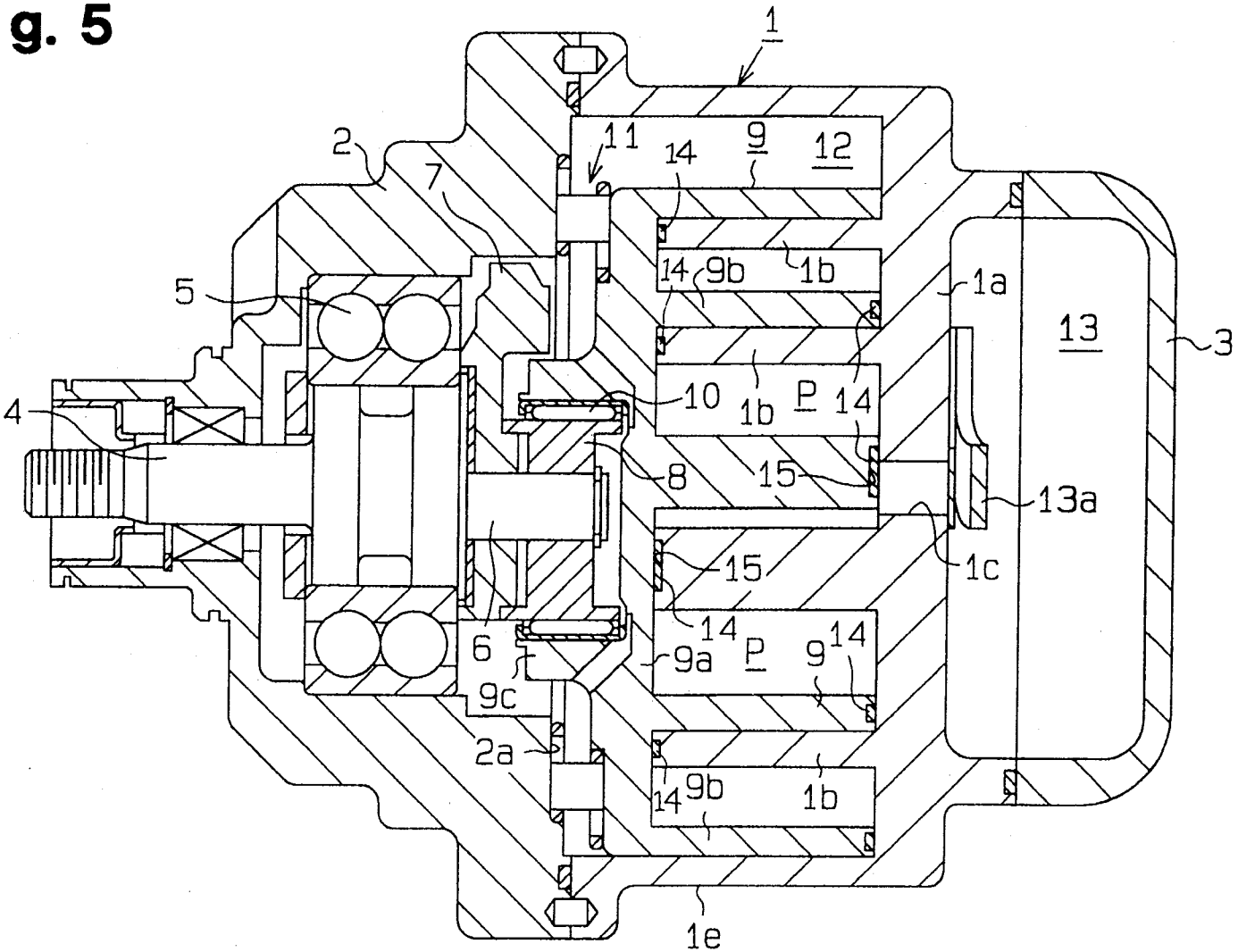

A scroll type compressor shown in FIG. 5 includes a front housing 2, rear housing 3 and fixed scroll 1 integrally formed within a cylindrically shaped center housing 1*e* that is disposed between the front and rear housings 2 and 3. A drive shaft 4 is rotatably supported in a front housing 2 through a radial bearing 5. A shaft 6 eccentrically displaced with respect to the center axis of the drive shaft 4 projects axially inward from the inner distal portion of the shaft 4. A balance weight 7 and bushing 8 are rotatably mounted on the eccentric shaft 6.

Figure 1:
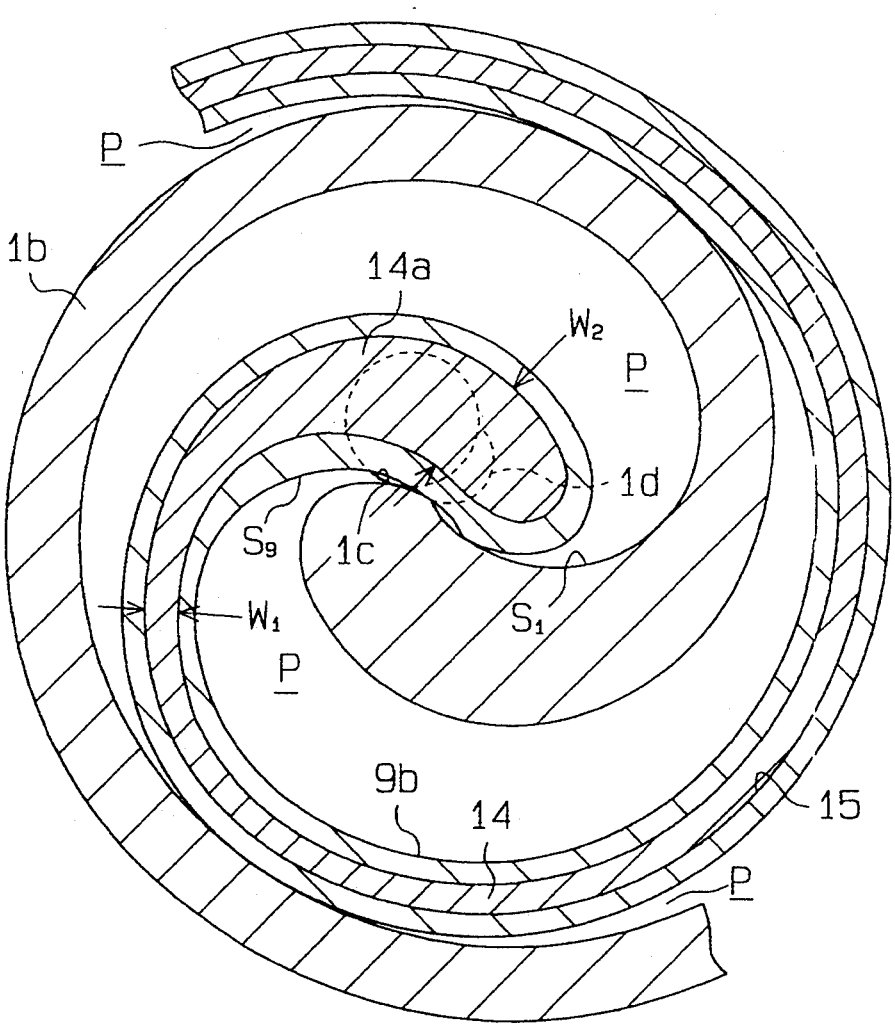

An orbiting scroll 9 is accommodated in the center housing 1*e*. The orbiting scroll 9 includes an orbiting end plate 9*a*, an orbiting spiral element 9*b* that is integrally formed with one surface of the plate 9*a*, and a cylindrically shaped boss 9*c*. The boss 9*c* is integrally formed with the rear central portion of the plate 9*a*. Further, the boss 9*c* is in rotational communication with the periphery of the bushing 8, by means of a radial bearing 10, such that the orbiting scroll 9 is able to rotate relative to the bushing 8. As shown in FIGS. 1 and 5, the fixed scroll 1 includes a fixed end plate 1*a* and a fixed spiral element 1*b*. Both spiral elements 1*b* and 9*b* are interfitted at an offset angle to form movable line contacts. As a result, a plurality of compression chambers P are defined by the fixed and orbiting end plates 1*a* and 9*a*, and the fixed and orbiting spiral elements 1*b* and 9*b* respectively.

As shown in FIG. 5, a well-known anti-spin-mechanism 11 is interposed between a pressure receiving wall 2*a* of the front housing 2 and the orbiting end plate 9*a*. The anti-spin-mechanism 11 causes the orbiting scroll 9 to rotate around the center axis of the fixed scroll 1 while limiting the rotation of the orbiting scroll 1 about its own axis. Further, the mechanism 11 transmits thrust reaction force originating from gas compression during the compression stroke from the orbiting scroll 9 to the wall 2*a* (e.g., referring to Japanese Unexamined Patent Publication No. 2-308990).

A suction chamber 12 is formed around the spiral elements 1*b* and 9*b* in the center housing 1*e*. A discharge port 1*c* is formed at the central portion of the fixed end plate 1*a*. Each of the compression chambers P is enabled to communicate with a discharge chamber 13 defined by the rear housing 3 and the plate 1*a* through the discharge port 1*c*. The discharge port 1*c* may be shut by means of a discharge valve 13*a* that is disposed in the discharge chamber 13. Closing or opening operation of the valve 13*a* is carried out, based upon the correlation of the pressure within the discharge chamber 13 and the pressure within the discharge port 1*c*. Generally, according to an air conditioning system, the suction chamber 12 communicates with an external suction refrigerant gas passage of cooling device (not shown), via a suction flange (not shown). Further, the discharge chamber 13 communicates with an external discharge refrigerant gas passage (not shown), via a discharge flange (not shown).

The orbiting scroll 9 rotates around the center axis of the drive shaft 4 and the refrigerant gas which is fed from a suction port (not shown) to suction chamber 12, is then introduced into the compression chamber P defined between both scrolls 1 and 9.

During the course of the orbiting scroll 9's rotation, the volume of compression chamber P gradually decreases as the rotation progresses. Gas introduced into the compression chamber P is compressed when the chamber P decreases in volume according to the progression of the rotating spiral member. At the same time, as the inner tip portions of the spiral elements 1*b* and 9*b* approach each other, the compression chamber P moves toward the central portion of the fixed scroll 1. The compressed refrigerant gas is discharged into the discharge chamber 13, via the discharge port 1*c* of the fixed plate 1*a*.

As shown in FIG. 1, a seal groove 15 is formed on the distal end surface of the orbiting spiral element 9*b* of the orbiting scroll 9. The seal groove 15 extends along the orbiting spiral element 9*b*. As a result, the groove 15 extends in the spiral manner from the center of the orbiting scroll 9 to the periphery thereof. The groove 15 accommodates a seal 14 having a shape corresponding to the groove 15. The seal 14 includes an enlarged tip portion 14*a* wider in its width $W_2$ than width $W_1$ of the remaining portions of orbiting spiral element 9*b*. As shown in FIG. 5, the fixed spiral element 1*b* of the scroll 1 has a seal groove 15 that accommodates a seal 14 similar to the above-described scroll 9.

Figure 2:
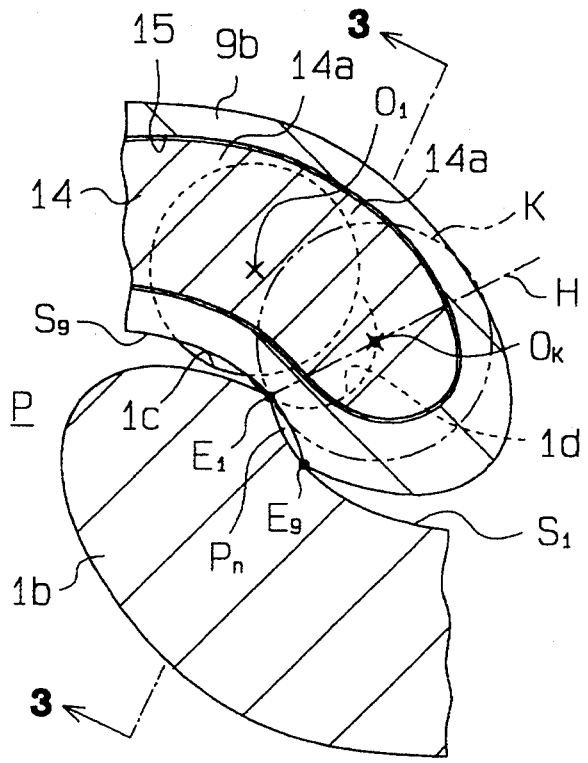
Figure 3:
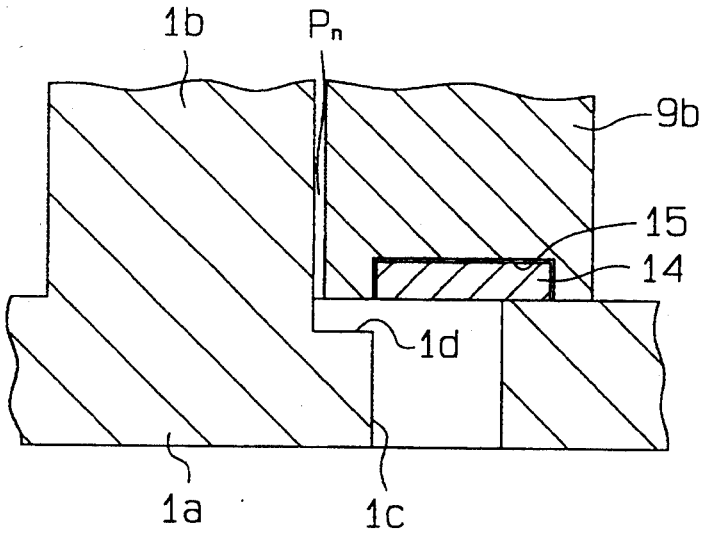

FIGS. 2 and 3 show an essential portion of the present invention such as the layout of the discharge port 1*c* and communicating passage 1*d*. As shown in FIG. 2, a point $O_2$ is a center point of involute generating circle K for forming an inner involute curve $S_1$ of the fixed scroll 1. A point $E_1$ is defined on the involute generating circle K and is the initial point of inner involute surface $S_1$. A straight line H connects between the center $O_2$ and the initial point $E_1$. A center $O_1$ of the discharge port 1*c* is located off from the line H opposite to the fixed involute surface $S_1$ with respect to the line H. As shown in FIG. 3, the communicating passage 1*d* is engraved in the fixed end plate in the vicinity of the discharge port 1*c*. The radius of the discharge port, where the point $O_1$ is the center of the discharge port, is shorter than the distance between the center of the discharge port $O_1$ and the line H. Instead of this, the contour line of the passage 1*d* is arranged to contact with a part of the arc shaped distal surface of the fixed spiral element 1*b*.

An initial point $E_9$ of an involute inner surface $S_9$ of the orbiting spiral element 9*b* rapidly approaches the initial point $E_1$ of the inner peripheral surface $S_1$ at the final compression stage while the surface $S_9$ of the orbiting spiral element 9*b* is contacting with the surface $S_1$ of the fixed spiral element 1*b*. Consequently, a minimized compression chamber Pn is defined between both inner peripheral surfaces $S_1$ and $S_9$. As shown in FIG. 2, however, the discharge port 1*c* is disposed offset from the line H in a direction opposite the fixed involute surface $S_1$ and a distance greater than the radius of the involute generating circle K. The minimized compression chamber Pn must communicate with the discharge port 1*c* through the passage 1*d*. Therefore, the compression refrigeration gas in the chamber Pn is introduced into the discharge port 1*c* through the passage 1*d*, and then discharged into the discharge chamber 13 through the discharge port 1*c*.

Figure 4:
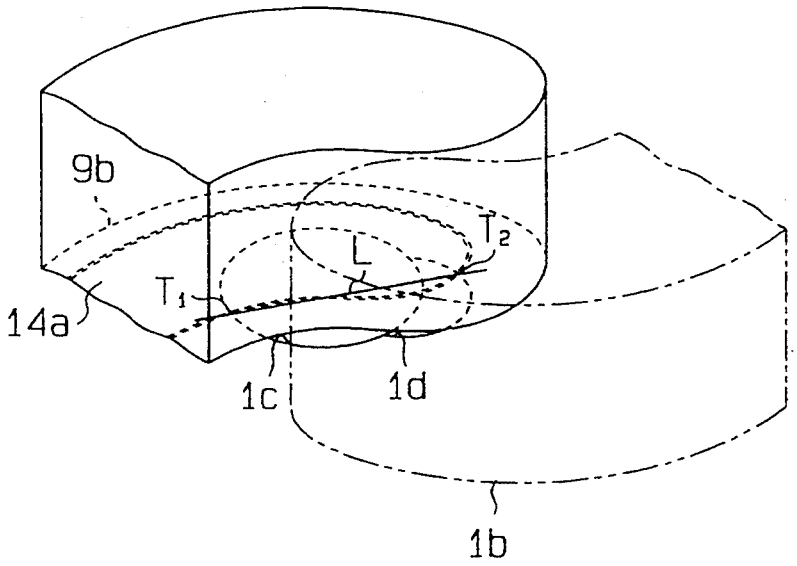

According to this embodiment, the enlarged tip portion 14*a* of the seal 14 covers the discharge port 1*c* during the final compression stage, as shown in FIGS. 2 and 4. Therefore, the enlarged tip portion 14*a* is tightly supported by the edge wall of the discharge port 1*c* in a supporting point T1 located at the middle portion thereof and another supporting point T2 located at the tip portion thereof. In other words, as shown in FIG. 4, the area protruding beyond or cantilevered over a line L connecting between both points T1 and T2 is extremely small. Therefore, this structure prevents the seal 14 sagging into the discharge port 1*c* because in order to sag the seal material along line L (the longest unsupported portion) would have to stretch. Therefore wear of and damage to the seal 14 are prevented.

Figure 7:
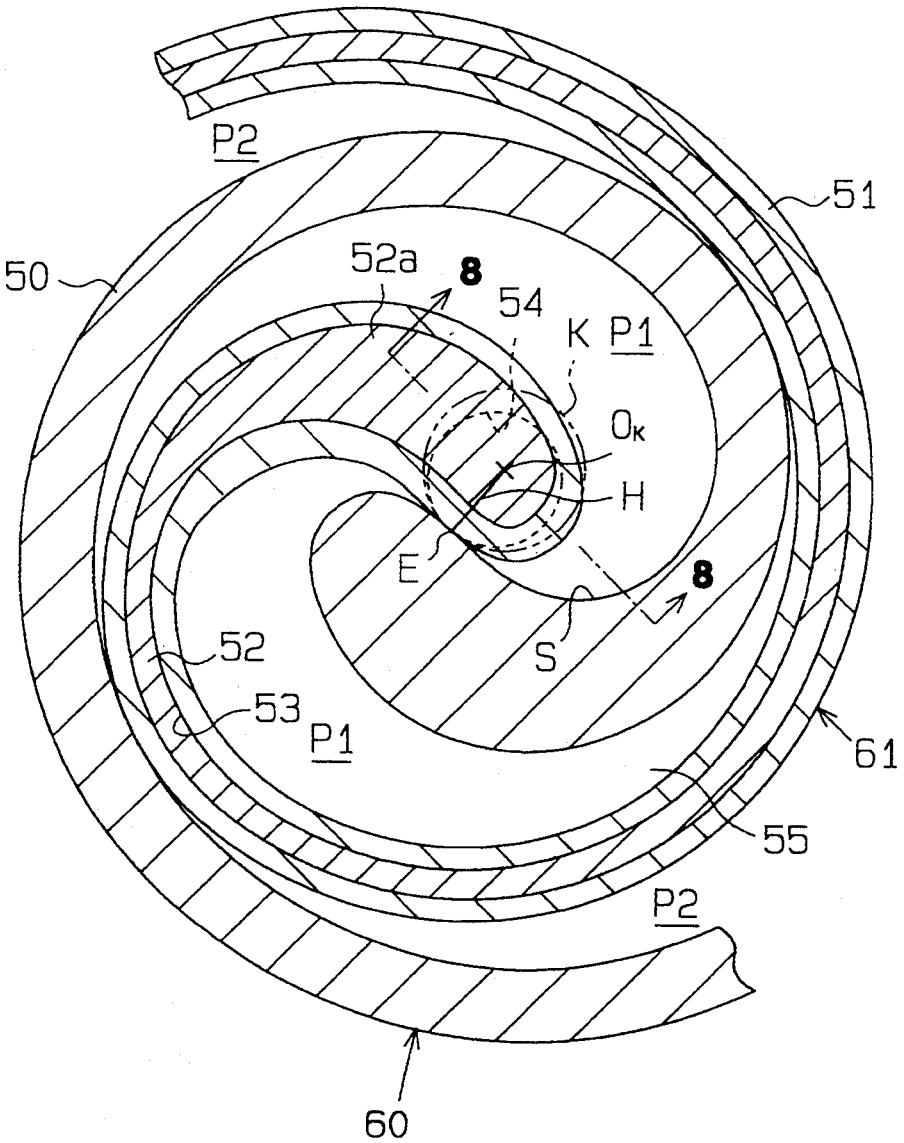
Fig. 7 (Prior Art)
FIG. 7 is a cross-sectional view showing both spiral elements of a conventional scroll type compressor.
Figure 8:
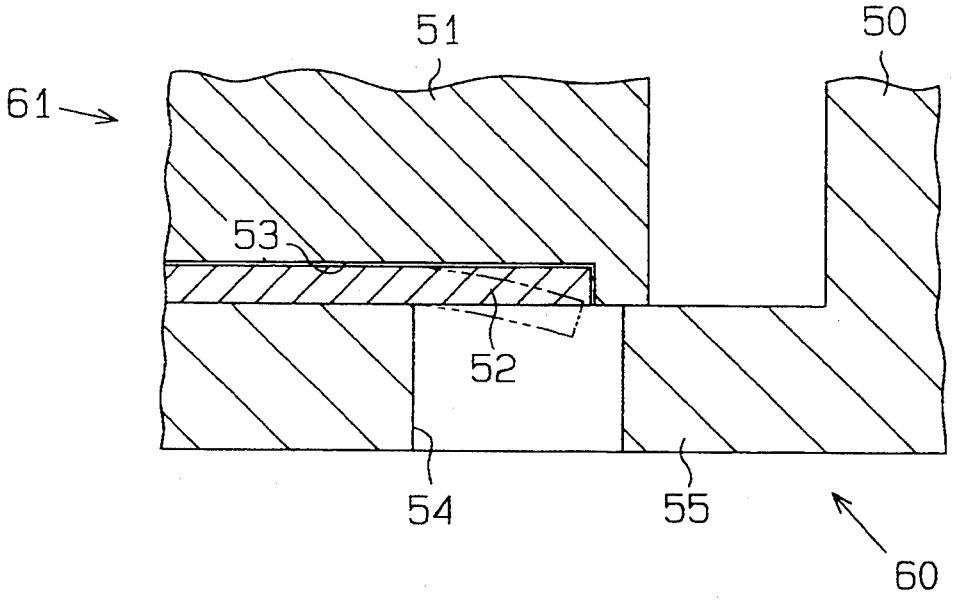
Fig. 8 (Prior Art)
FIG. 8 is a cross-sectional view taken along the line 8—8 shown in FIG. 7.

As described above, according to teachings of the present invention, the discharge port is remotely located with respect to the location of the involute generating circle at the final compression stage location, as shown in FIG. 2. Compare this architecture with that of a conventional compressor, wherein the discharge port 54 is entirely accommodated in the involute generating circle, as shown in FIG. 7. Therefore, according to the present invention, the entire tip portion of the seal 14 does not confront against the discharge port 1*c* during the final compression stage. Further, since the communication passage 1*d* communicating the minimized compression chamber (in the final compression stage) with the discharge port, is disposed in the fixed end plate 1*a* of the fixed scroll 1, the highly pressurized gas is discharged from the passage 1*d* to the discharge port 1*c*. Therefore, the durability of the central portion of the seal disposed at the distal surface of the spiral element of the orbiting scroll is significantly increased.

Although only one embodiment of the present invention has been described in detail herein, it should be apparent to those skilled in the art that the present invention may be embodied in many other specific forms without departing from the spirit or scope of the invention. Particularly, it should be understood that the following modes are applied.

Figure 6A:
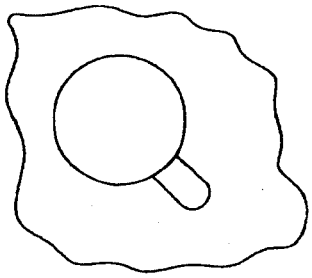
FIGS. 6A, 6B, 6C show an example of a communicating passage formed in the end plate.
Figure 6B:
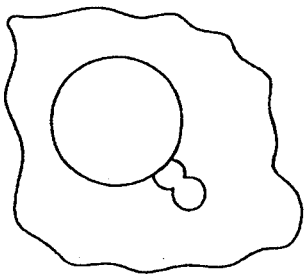
Figure 6C:
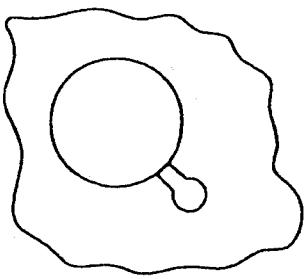

According to the above-described embodiment, the communicating passage 1*d* has an arc shape. If the passage 1*d* is enabled to communicate the minimized compression chamber in the final compression stage with the discharge port 1*c*, any shape can be employed for the passage 1*d*, such as a gutter shape recess as shown in FIG. 6*a*, a plurality of circular recesses as shown in FIG. 6*b* and the combination of a recess and groove as shown in FIG. 6*c*. The present invention can be embodied in a compressor having a generally uniform width seal without an enlarged tip portion 14*a*. Further, the involute curve for the spiral element can be replaced by another type of curve such as an Archimedes curve.

Therefore, the present examples and embodiments are to be considered as illustrative and not restrictive and the invention is not to be limited to the details given herein, but may be modified within the scope of the appended claims.

What is claimed is:

1. A scroll type compressor comprising:

a fixed scroll including a fixed end plate having a spiral element disposed thereon having an inner peripheral surface ($S_1$) defined by the locus of points of a curve generated based upon a phantom circle (K) imaginarily located in said fixed end plate;

an orbiting scroll including an orbiting end plate having an orbiting spiral element disposed thereon;

said spiral elements of said fixed and orbiting scroll being radially and angularly offset and interfit with each other to form line contacts extending between said fixed and orbiting end plates which define at least one fluid pocket;

said orbiting spiral element having an end surface contacting said fixed end plate and in which a spiral groove is formed;

a seal disposed in said spiral groove to improve the fluid seal of said fluid pocket;

a discharge port formed in said fixed end plate for discharging compressed fluid from within said fluid pocket to the outside and having a center ($O_1$) located on the opposite side of an imaginary line (H) from said fixed inner peripheral surface ($S_1$) where said line (H) extends between the center of said phantom circle (K) and an initial point ($E_1$) of said inner peripheral surface ($S_1$) such that said discharge port is spaced from said imaginary line (H); and a communicating passage recessed in said fixed end plate for communicating said fluid pocket in the final compression stage with said discharge port.

2. A compressor according to claim 1, wherein said discharge port has an annular shape and is located at a distance greater than the radius of said phantom circle (K).

3. A compressor according to claim 1, wherein said seal includes an enlarged tip portion wider in its width $W_2$ than width $W_1$ of other portions.

4. A compressor according to claim 1, wherein said fixed spiral element has an end surface contacting said orbiting end plate and in which a spiral groove is formed; and said compressor further includes a seal disposed in said spiral groove of the fixed spiral element to improve the air tightness of said fluid pocket.

5. A compressor according to claim 1 including an anti-spin-mechanism which causes said orbiting scroll to rotate around the center axis of said fixed scroll, limiting the rotation of the axis itself of said orbiting scroll.

6. A scroll type compressor comprising;

a fixed scroll including a fixed end plate having an involute spiral element disposed thereon having an inner peripheral surface ($S_1$) defined by the locus of points of an involute curve generated based upon a phantom circle (K) imaginarily located in said fixed end plate and having an initial point ($E_1$);

an orbiting scroll including an orbiting end plate having an orbiting involute spiral element disposed thereon;

said spiral elements of the fixed and orbiting scroll being radially and angularly offset and interfit with each other to form line contacts extending between said fixed and orbiting end plates which define at least one fluid pocket;

said orbiting spiral element having an end surface contacting said fixed end plate and in which a spiral groove is formed;

a seal disposed in said spiral groove to improve the fluid seal of said fluid pocket;

a discharge port formed in said fixed end plate for discharging compressed fluid from within said fluid pocket to the outside and having a center ($O_1$) located on the opposite side of an imaginary line (H) from said fixed inner peripheral surface ($S_1$) where said line (H) extends between the center of said phantom circle (K) and an initial point ($E_1$) of said inner peripheral surface ($S_1$) such that said discharge port is spaced from said imaginary line (H); and a communicating passage recessed in said fixed end plate for communicating said fluid pocket in the final compression stage with said discharge port.

7. A compressor according to claim 6, wherein said discharge port has an annular shape and is located at a distance greater than the radius of said involute generating circle (K).

* * * * *

UNITED STATES PATENT AND TRADEMARK OFFICE

CERTIFICATE OF CORRECTION

PATENT NO. : 5,427,513

DATED : June 27, 1995

INVENTOR(S) : K. Yamada et al

It is certified that error appears in the above-indentified patent and that said Letters Patent is hereby corrected as shown below:

Column 5, line 13, $O_2$ should read --$O_k$--;
line 17, $O_2$ should read --$O_k$--.

Signed and Sealed this

Nineteenth Day of December, 1995

*Attest:*

BRUCE LEHMAN

*Attesting Officer*

*Commissioner of Patents and Trademarks*